US010274878B2

(12) United States Patent
Suzuki et al.

(10) Patent No.: US 10,274,878 B2
(45) Date of Patent: Apr. 30, 2019

(54) IMAGE FORMING APPARATUS WITH FIXING DEVICE HAVING FAN AND MOVABLE SHUTTER

(71) Applicant: CANON KABUSHIKI KAISHA, Tokyo (JP)

(72) Inventors: Ryo Suzuki, Kashiwa (JP); Hisashi Nakahara, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/691,273

(22) Filed: Aug. 30, 2017

(65) Prior Publication Data

US 2018/0059590 A1 Mar. 1, 2018

(30) Foreign Application Priority Data

Aug. 31, 2016 (JP) ..... 2016-169373

(51) Int. Cl.
*G03G 15/20* (2006.01)
*G03G 21/20* (2006.01)

(52) U.S. Cl.
CPC ..... *G03G 15/2042* (2013.01); *G03G 15/2017* (2013.01); *G03G 21/206* (2013.01)

(58) Field of Classification Search
CPC ..... G03G 15/2017; G03G 15/2021; G03G 15/2042; G03G 15/2082; G03G 21/206
USPC ..... 399/45, 92, 69, 329, 330, 334; 219/216
See application file for complete search history.

(56) References Cited

U.S. PATENT DOCUMENTS

| | | | | |
|---|---|---|---|---|
| 7,542,692 | B2 * | 6/2009 | Yamamoto | G03G 15/2042 219/216 |
| 9,081,340 | B2 * | 7/2015 | Suzuki | G03G 15/2042 |
| 2007/0059001 | A1 * | 3/2007 | Matsuura | G03G 21/206 399/45 |
| 2013/0108299 | A1 * | 5/2013 | Minagawa | G03G 15/2017 399/69 |
| 2014/0321873 | A1 * | 10/2014 | Kadowaki | G03G 15/2017 399/69 |

FOREIGN PATENT DOCUMENTS

| | | | |
|---|---|---|---|
| JP | 2009109722 | A * | 5/2009 |
| JP | 2012-252194 | A | 12/2012 |
| JP | 2013-97055 | A | 5/2013 |
| JP | 2013-134421 | A | 7/2013 |
| JP | 2016-139085 | A | 8/2016 |

* cited by examiner

*Primary Examiner* — Robert B Beatty
(74) *Attorney, Agent, or Firm* — Canon U.S.A., Inc. IP Division

(57) ABSTRACT

An image forming apparatus includes a fixing unit including a heating member and a pressure member forming a nip portion with the heating member, an air blowing unit including a fan, an opening portion, and an adjustment member for adjusting an opening width of the opening portion, a control unit controlling the fan, and a temperature detection member detecting a temperature of an area, serving as a non-sheet passing area in a recording material having a predetermined size, in a non-air blowing area in the heating member closer to the center of the heating member than the opening portion in a width direction of the recording material, and the recording material having a width by which a part of the non-air blowing area is overlapped with the non-sheet passing area, and the control unit controls the fan according to a temperature detected by the temperature detection member.

15 Claims, 12 Drawing Sheets

IMAGE FORMING APPARATUS WITH FIXING DEVICE HAVING FAN AND MOVABLE SHUTTER

BACKGROUND OF THE DISCLOSURE

Field of the Disclosure

The present disclosure relates to an electrophotographic image forming apparatus such as a copying machine or a printer loaded with a fixing device which fixes an image on a recording material onto the recording material.

Description of the Related Art

In recent years, as a fixing device loaded into an image forming apparatus, a fixing device using a cylindrical film has been used. The fixing device includes a cylindrical film, a heater which heats the film, and a roller, together with the film, forming a fixing nip portion, and heats a recording material which bears an unfixed toner image while conveying the recording material by the fixing nip portion, to fix the image on the recording material. The fixing device has the advantages of warming up in a short time and consuming a small amount of power when waiting.

On the other hand, it is known that, when the fixing device continuously performs fixing processing on recording materials having a small width (hereinbelow referred to as a small-size recording material), a portion of the fixing device, through which the recording materials do not pass (a non-sheet passing portion), excessively rises in temperature, i.e., a so-called non-sheet passing portion temperature rise easily occurs.

Japanese Patent Application Laid-Open No. 2013-134421 discusses an image forming apparatus including a fan for blowing air into a non-sheet passing portion in a fixing unit to cool the non-sheet passing portion and capable of adjusting an air blowing area in the fan depending on the width of a recording material by moving a shutter. The fan is controlled according to a temperature detected by a temperature detection member provided in an area into which air can be blown in a non-sheet passing portion in a film or a heater.

In recent years, an image forming apparatus such as a printer has been required to further improve in media flexibility corresponding to a variety of media.

Therefore, it may be required to perform fixing processing on a small-size recording material having a smaller width than that of an area into which air cannot be blown (a non-air blowing area) between areas into which air can be blown (opening portions) in the fan discussed in Japanese Patent Application Laid-Open No. 2013-134421.

However, a non-air blowing area exists in a non-sheet passing area in the small-size recording material and a temperature in the non-air blowing area cannot be monitored. For this reason, a rise in temperature of the non-sheet passing portion is not easily suppressed by control of the fan. Therefore, the rise in temperature of the non-sheet passing portion is suppressed by extending a period to be an interval between the recording material and a succeeding recording material, resulting in reduced productivity of the small-size recording material.

SUMMARY

According to an aspect of the present disclosure, an image forming apparatus includes an image forming unit configured to form an unfixed toner image on a recording material, a fixing unit including a heating member and a pressure member forming a nip portion with the heating member, the fixing unit being configured to heat the recording material having the unfixed toner image formed thereon while conveying the recording material by the nip portion, and configured to fix the unfixed toner image onto the recording material, an air blowing unit including a fan, an opening portion provided to oppose an end of the heating member, and an adjustment member for adjusting an opening width of the opening portion, configured to guide air from the fan toward the heating member via the opening portion, a control unit configured to control the fan, and a temperature detection member configured to detect a temperature of an area, serving as a non-sheet passing area in a recording material having a predetermined size, in a non-air blowing area in the heating member, the non-air blowing area being an area, which is closer to the center of the heating member than the opening portion, of the heating member in a width direction of the recording material perpendicular to a conveyance direction of the recording material and into which air is not blown by the air blowing unit regardless of the opening width, and a recording material having the predetermined size being a recording material having a width by which a part of the non-air blowing area is overlapped with the non-sheet passing area, and the control unit controls the fan according to a temperature detected by the temperature detection member when the recording material having the predetermined size is conveyed by the nip portion.

Further features of the present disclosure will become apparent from the following description of exemplary embodiments with reference to the attached drawings.

DESCRIPTION OF THE EMBODIMENTS

An exemplary embodiment of the present disclosure will be described below with reference to the drawings with examples.

(1) Image Forming Unit

Figure 2:
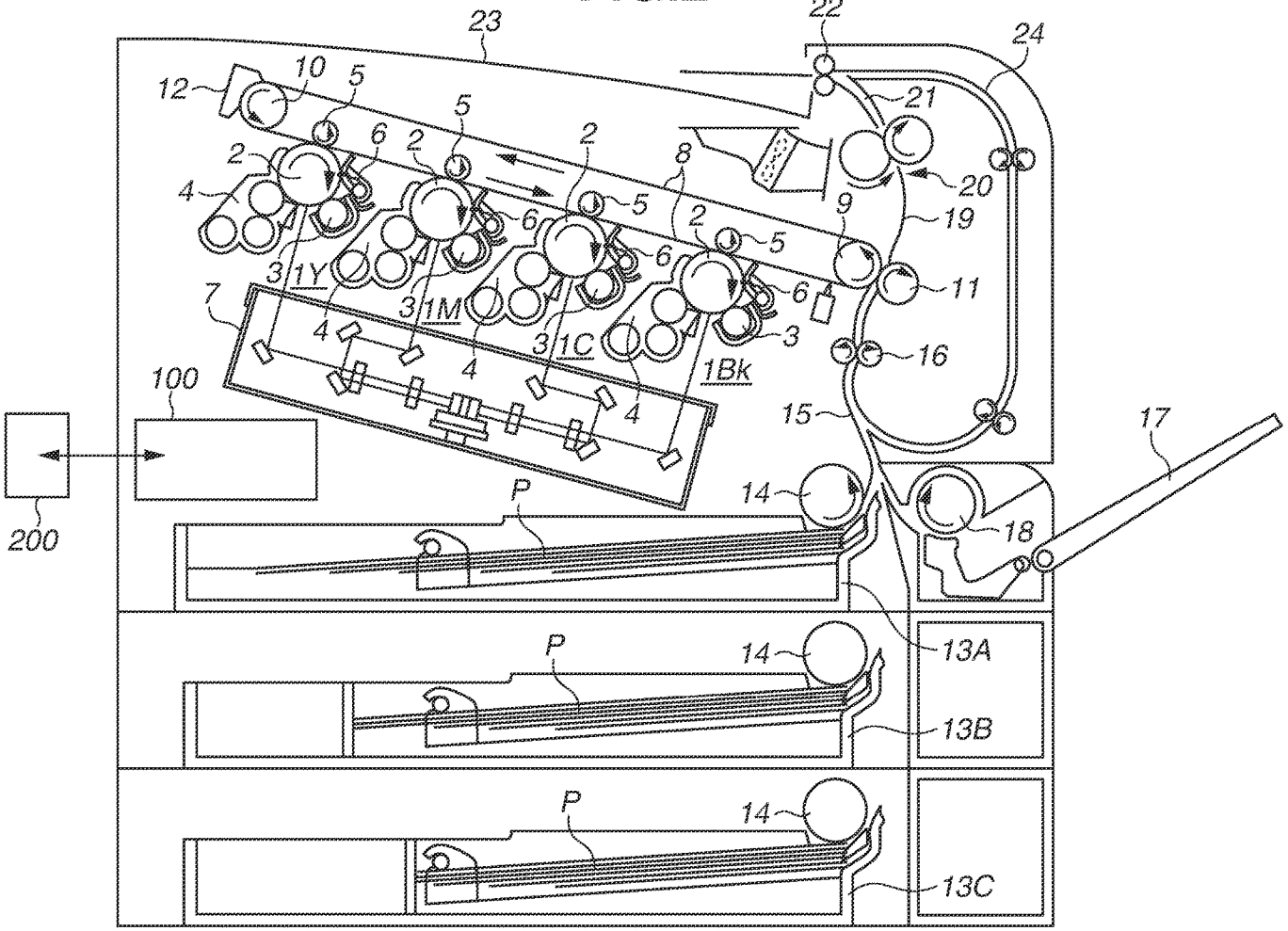
FIG. 2 is a schematic sectional view of an image forming apparatus loaded with the fixing device according to an exemplary embodiment.

FIG. 2 is a schematic view illustrating a schematic configuration of a laser beam printer serving as an image forming apparatus according to the present exemplary embodiment which is loaded with a fixing device.

The outline of an image forming unit will be described below. The printer performs an image forming operation according to image information from an external host apparatus 200 communicably connected to a control circuit unit (control unit) 100, and can form a full-color image on a recording material and output the formed full-color image. The control circuit unit 100 according to the present exemplary embodiment is a central processing unit (CPU).

Examples of the external host apparatus 200 include a computer and an image reader. The control circuit unit 100 sends and receives a signal to and from the external host apparatus 200. The control circuit unit 100 further sends and receives a signal to and from various types of image forming equipment, to control an image formation sequence.

An endless and flexible intermediate transfer belt (hereinbelow abbreviated as a belt) 8 is stretched between a secondary transfer counter roller 9 and a tension roller 10, and is driven to rotate at a predetermined speed in a counterclockwise direction indicated by an arrow when the roller 9 is driven. A secondary transfer roller 11 is pressed against the secondary transfer counter roller 9 with the belt 8 interposed therebetween. An abutment portion between the belt 8 and the secondary transfer roller 11 is a secondary transfer portion.

First to fourth image forming units 1Y, 1M, 1C, and 1Bk are arranged in a row with predetermined spacing along a movement direction of the belt 8 below the belt 8. Each of the image forming units 1Y, 1M, 1C, and 1Bk is an electrophotographic process mechanism using a laser exposure system, and includes a drum-type electrophotographic photosensitive member (hereinbelow abbreviated as "drum") 2 serving as an image bearing member which is driven to rotate at a predetermined speed in a clockwise direction indicated by an arrow. A primary charger 3, a development device 4, a transfer roller 5 serving as a transfer unit, and a drum cleaner device 6 are arranged around each of the drums 2. Each of the transfer rollers 5 is arranged inside the belt 8, and is pressed against the corresponding drum 2 with a descending side belt portion of the belt 8 interposed therebetween. An abutment portion between each of the drums 2 and the belt 8 is a primary transfer portion. A laser exposure device 7 corresponds to the drum 2 in each of the image forming units 1Y, 1M, 1C, and 1Bk, and includes a laser light emitting unit which performs light emission corresponding to a time-series electrical digital pixel signal of image information to be fed, a polygon mirror, and a reflection mirror.

The control circuit unit 100 operates each of the image forming units based on a color separation image signal input from the external host apparatus 200. By this operation, in the first to fourth image forming units 1Y, 1M, 1C, and 1Bk, yellow, magenta, cyan, and black toner images (unfixed toner images) are respectively formed at a predetermined control timing on surfaces of the drums 2 which rotate. Description of an electrophotographic image forming principle/process for forming the toner images on the drums 2 is omitted.

The respective toner images formed on the surfaces of the drums 2 in the image forming units 1Y, 1M, 1C, and 1Bk are sequentially superimposed and transferred onto an outer surface of the belt 8 which is driven to rotate in a forward direction of rotation of each of the drums 2 and at a speed corresponding to a rotation speed of each of the drums 2. In this way, an unfixed full-color toner image is synthetically formed by superimposing the above-described four toner images on the surface of the belt 8.

On the other hand, a sheet feeding roller 14 in selected one of sheet feeding cassettes 13A, 13B, and 13C arranged in vertically multiple stages, in which recording materials P with various widths, from small to large widths, are stacked and stored, is driven at a predetermined sheet feeding timing. In this way, one of the recording materials P stacked and stored in the selected one of the sheet feeding cassettes arranged in the vertically multiple stages is separated and fed, and is conveyed to a registration roller 16 via a vertical conveyance path 15. When manual sheet feeding is selected, a sheet feeding roller 18 is driven. Then, one of the recording materials P stacked and set on a manual feed tray (multipurpose tray) 17 is separated and fed, and is conveyed to the registration roller 16 via the vertical conveyance path 15.

The registration roller 16 conveys the recording material P so that a trailing edge of the recording material P reaches the secondary transfer portion to match a timing at which a leading edge of the full-color toner image on the belt 8 which rotates reaches the secondary transfer portion. Then, in the secondary transfer portion, the full-color toner images on the belt 8 are collectively secondarily transferred onto a surface of the recording material P. A unit having a configuration required to secondarily transfer the toner image onto the recording material P is an image forming unit. The recording material P, which has passed through the secondary transfer portion, is separated from a surface of the belt 8, is guided into a vertical guide 19, and is introduced into a fixing device (fixing unit) 20. The fixing device 20 melts the toner image in a plurality of colors and fixes the melted toner image onto the recording material P. The recording material P, which has left the fixing device 20, is discharged onto the sheet discharge tray 23 by the sheet discharge roller 22 via a conveyance path 21. The surface of the belt 8, from which the recording material P has been separated in the secondary transfer portion, is cleaned by a belt cleaning device 12 removing a residual sticking substance such as residual secondary transfer toner, and is repeatedly used for image formation. In a monochrome print mode, only the fourth image forming unit 1Bk, which forms a black toner image, is controlled. When a both-surface printing mode is selected, the recording material P having its first surface already printed is fed onto a sheet discharge tray 23 by a sheet discharge roller 22, and rotation of the sheet discharge roller 22 is converted into reverse rotation before a trailing edge of the recording material P passes through the sheet discharge roller 22. In this way, the recording material P is switched back, and is introduced into a re-conveyance path 24. The recording material P is conveyed again to the registration roller 16 with the front and back thereof reversed. Then, the recording material P is conveyed to the secondary transfer portion and the fixing device 20, and is discharged onto the sheet discharge tray 23, like at the time of first surface printing.

(2) Fixing Unit

In the following description, for a fixing device or a member constituting the fixing device, a longitudinal direction is a direction parallel to a direction perpendicular to a recording material conveyance direction within a plane of a recording material conveyance path. For the fixing device, the front is a surface on the introduction side of a recording material, and the left or right is the left or right of the fixing device as viewed from the front. The width of the recording material is the size of the recording material in the direction perpendicular to the recording material conveyance direction on the surface of the recording material.

Figure 1:
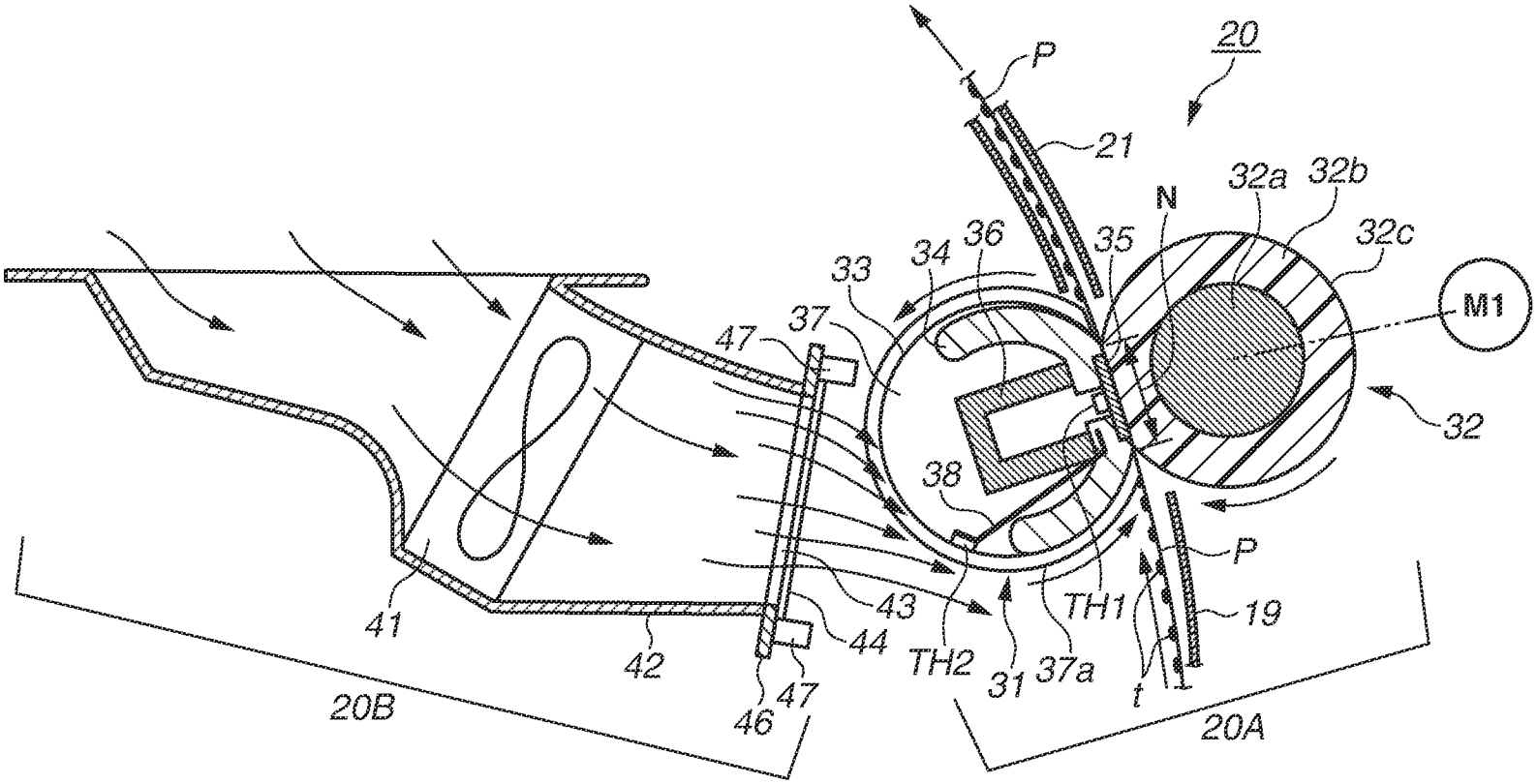
FIG. 1 is a schematic sectional view of a fixing device according to an exemplary embodiment.
Figure 3:
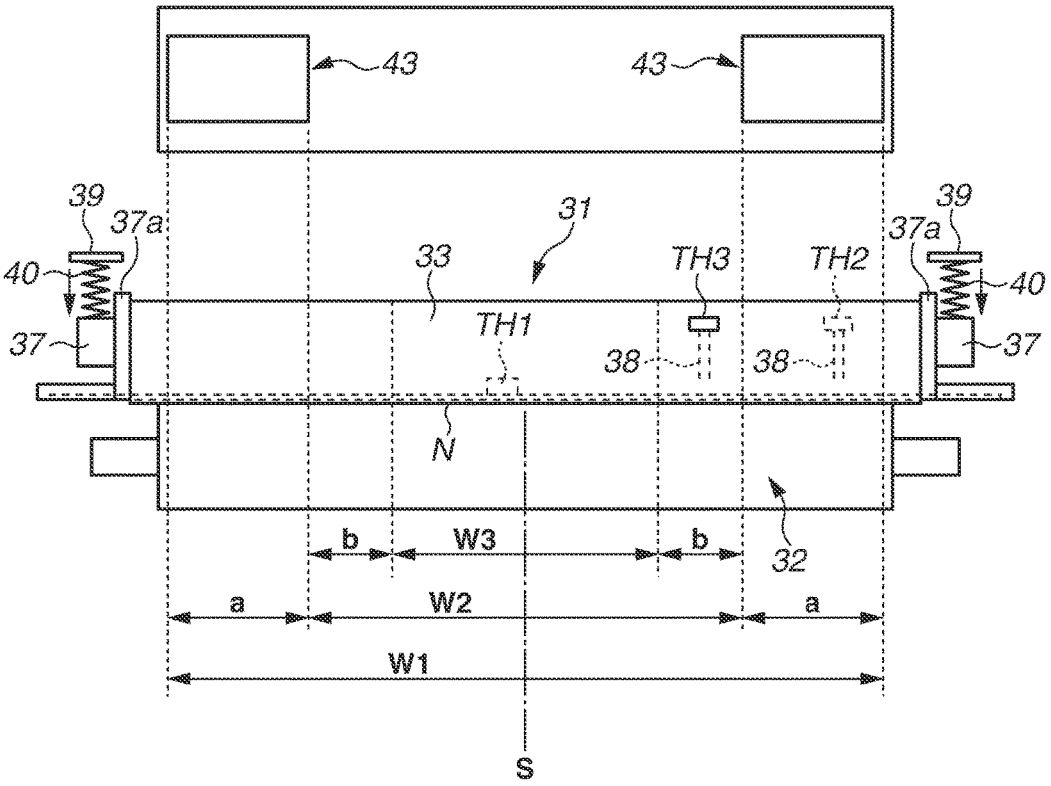
FIG. 3 is a schematic front view of the fixing device according to an exemplary embodiment.
Figure 4:
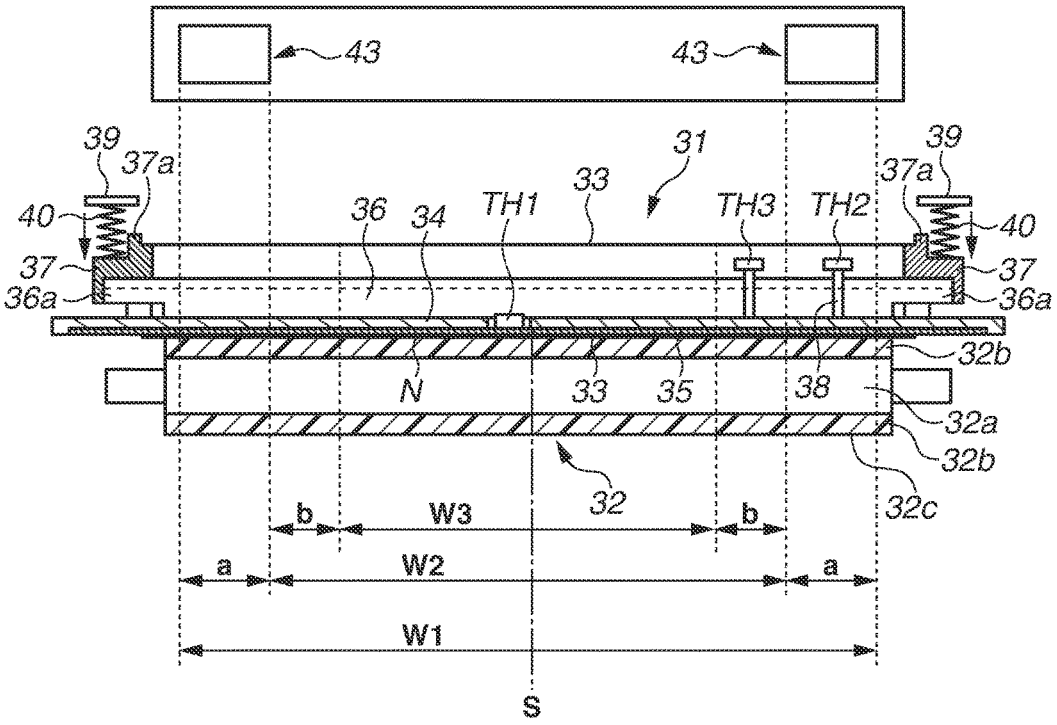
FIG. 4 is a schematic sectional view of a fixing unit according to an exemplary embodiment.

FIG. 1 is a schematic view of a fixing device (fixing unit) 20A and an air blowing unit 20B according to the present exemplary embodiment. FIG. 3 is a schematic front view of the fixing unit 20A, and FIG. 4 is a schematic sectional view of the fixing unit 20A. The air blowing unit 20B will be described below.

A film assembly 31 includes a cylindrical film 33 serving as a heating rotation member, a guide member 34 being of a gutter type having a substantially semi-circular arc shape in cross section and having heat resistance and stiffness, and a heater 35. The heater 35 is supported by a recess portion provided along a longitudinal direction of the guide member 34 on an outer surface of the guide member 34. The film 33 is loosely externally fitted in the guide member 34 to which the heater 35 is attached. The film assembly 31 further includes a stay 36 serving as a reinforcing member having a U shape in cross section, and end holders 37 respectively fitted in outwardly projecting arm portions 36*a* at both left and right ends of the stay 36. The end holder 37 includes a flange portion 37*a* contacting an end surface in a longitudinal direction of the film 33.

A pressure roller 32 serving as a pressure member includes a core metal 32*a*, and an elastic layer 32*b* composed of silicone rubber or the like formed outside the core metal 32*a*. The pressure roller 32 may include fluororesin layer 32*c* composed of polytetrafluoroethylene (PTFE), perfluoroalkoxy alkane (PFA), or fluorinated ethylene propylene (FEP) outside the elastic layer 32*b*, in order to improve the surface nature. In the pressure roller 32, both ends of the core metal 32*a* are rotatably supported on left and right side plates of an apparatus frame (not illustrated) with a bearing member interposed therebetween.

The film assembly 31 is arranged with its portion on the side of the heater 35 opposing the pressure roller 32, and pressure springs 40 are shrinkably provided between left and right end holders 37 and left and right fixed spring receiving members 39 of the apparatus frame (not illustrated). Because of the arrangement, the stay 36, the guide member 34, and the heater 35 are urged against the pressure roller 32. A force of the urging is set to a predetermined value, to press the heater 35 against the pressure roller 32 with the film 33 sandwiched therebetween, and to form a fixing nip portion N having a predetermined width in a recording material conveyance direction between the film 33 and the pressure roller 32.

Figure 5:
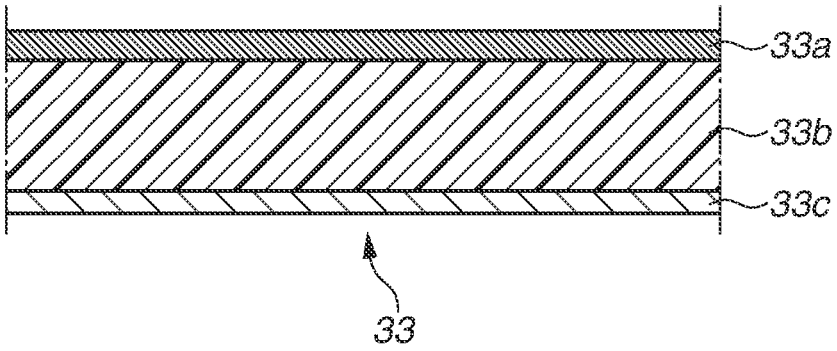
FIG. 5 is a schematic view of a layered structure of a film according to the exemplary embodiment.

The film 33 has a three-layer composite structure including a base layer 33*a*, an elastic layer 33*b*, and a release layer 33*c* in this order from the inner surface side toward the outer surface side, as illustrated in FIG. 5 illustrating a layered structure. For the base layer 33*a*, a heat-resistant film having a film thickness of 100 μm or less and preferably 50 μm or less and 20 μm or more can be used to reduce a heat capacity to improve a quick start characteristic. Examples can include films composed of stainless steel (SUS), polyimide, polyimide-amide, polyether ether ketone (PEEK), polyethersulfone (PES), polyphenylene sulfide (PPS), PTFE, PFA, and FEP. In the present exemplary embodiment, a cylindrical polyimide film having a diameter of 25 mm is used. For the elastic layer 33*b*, a silicone rubber having a rubber hardness of 10 degrees (JIS-A), having a heat conductivity of $4.18605\times10^{-1}$ W/m·° C. ($1\times10^{-3}$ [cal/cm.sec.deg]), and having a thickness of 200 μm is used. For the release layer 33*c*, a PFA coat layer having a thickness of 20 μm is used. A PFA tube may be used. A PFA coat is superior in that its thickness can be reduced and its material also has a larger effect of wrapping toner than the PFA tube. On the other hand, the PFA tube is superior in mechanical strength and electrical strength to the PFA coat. Therefore, the PFA tube and the PFA coat can be differently used depending on circumstances.

Figure 6:
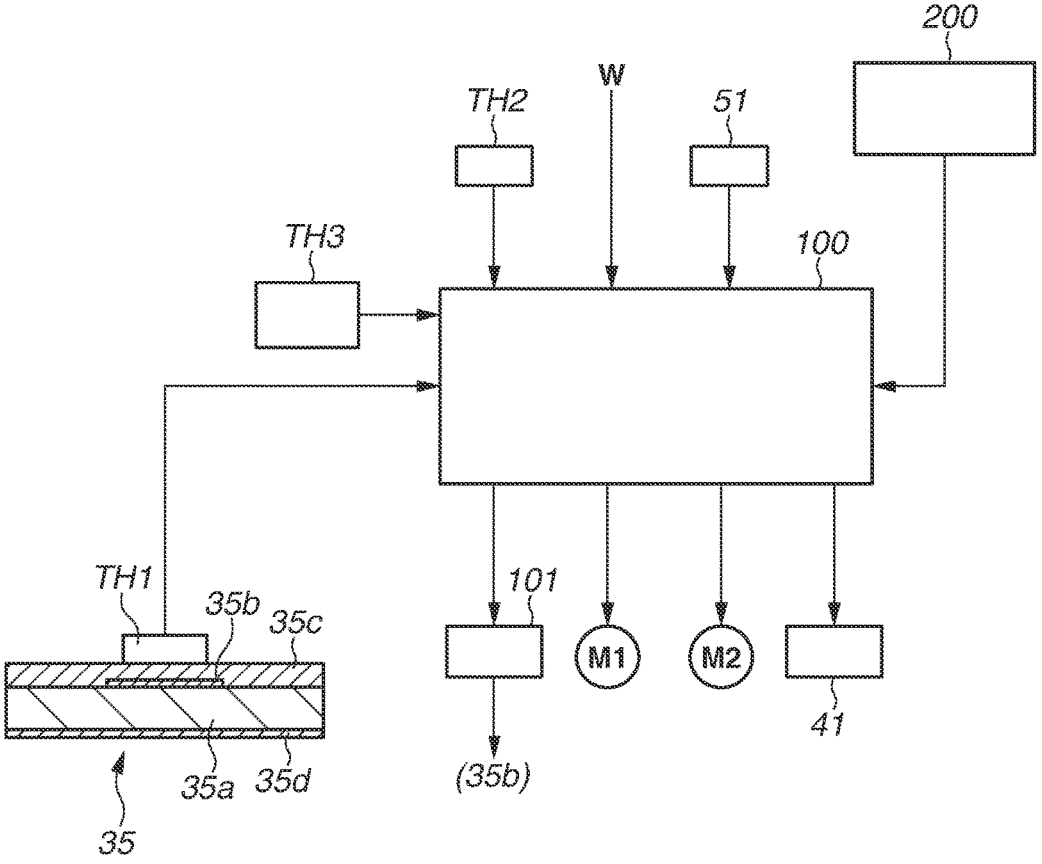
FIG. 6 is a schematic sectional view of a heater and a block diagram of a control system according to an exemplary embodiment.

The heater 35 is in the shape of a plate having a low heat capacity which is long in a direction perpendicular to a conveyance direction of a recording material P. FIG. 6 is a schematic sectional view and a control system diagram of the heater 35. The heater 35 includes a substrate 35*a*, a heating resistance layer 35*b* formed on the substrate 35*a*, and a protective layer 35*c*. The substrate 35*a* is formed of ceramic such as aluminum nitride. The heating resistance layer 35*b* is formed on a surface on a side opposite to a surface, which contacts the film 33, of the substrate 35*a* so that an electrical resistance material such as silver/palladium (Ag/Pd) has a thickness of approximately 10 μm and has a width of 1 to 5 mm by screen printing or the like. The protective layer 35*c* is formed of glass or fluororesin to cover the heating resistance layer 35*b*. In the present exemplary embodiment, a sliding member (lubricant member) 35*d* is provided on the surface, which contacts the film 33, of the substrate 35*a*.

The heater 35 is supported on a groove portion formed along a longitudinal direction in a substantially central portion on an outer surface of the guide member 34 with the surface, on which the sliding member 35*d* is provided, of the substrate 35*a* exposed thereto. In the fixing nip portion N, a surface of the sliding member 35*d* in the heater 35 and an inner surface of the film 33 contact and slide over each other. The heater 35 heats the film 33 serving as a heating member which rotates.

When power is supplied to the heating resistance layer 35*b* in the heater 35, the heating resistance layer 35*b* generates heat so that the heater 35 rises in temperature in an entire effective heating width A in the longitudinal direction of the heater 35. A thermistor TH1 provided on the heater 35 detects the temperature of the heater 35, and its output (a signal value relating to the temperature) is input to the control circuit unit 100 via an analog-to-digital (A/D) converter. The control circuit unit 100 controls power supplied to the heating resistance layer 35*b* from a power supply (a power supply unit or a heater driving circuit unit) 101 so that the temperature detected by the thermistor TH1 is maintained at a target temperature based on the input temperature information.

The pressure roller 32 is rotated in a direction (counterclockwise direction) indicated by an arrow illustrated in FIG. 1 by a motor (driving source) M1. A rotational force is exerted on the film 33 with a frictional force in the fixing nip portion N between the pressure roller 32 and an outer surface of the film 33 by the pressure roller 32 being driven to rotate. By this operation, the film 33 rotates around the outside of the guide member 34 in the counterclockwise direction indicated by the arrow while sliding with the inner surface thereof adhering to the heater 35 in the fixing nip portion N. The film 33 rotates at a rotation circumferential speed substantially corresponding to a rotation circumferential speed of the pressure roller 32. Right and left flange portions 37*a* function to regulate lateral shift by receiving an end of the film 33 which rotates on the side of the lateral shift when the film 33 has laterally shifted leftward or rightward along the length of the guide member 34. To improve a sliding property between the heater 35 and the film 33 in the fixing nip portion N, the sliding member 35*d* is disposed on a surface of the heater 35, and a lubricant such as heat-resisting grease is interposed between the sliding member S5 and the inner surface of the film 33. The pressure roller 32 starts to rotate in response to a print start signal, and supply of power to the heater 35 is started. The rotation circumferential speed of the film 33 becomes steady, and the recording material P having a toner image t borne thereon is introduced into the fixing nip portion N with its surface on the side of the borne toner image t directed toward the film 33 at a timing of when the temperature of the heater 35 has reached a predetermined temperature. The recording material P, together with the film 33, moves through the fixing nip portion N while adhering to the heater 35 with the film 33 interposed therebetween in the fixing nip portion N. In the process, the toner image t is heated and fixed onto a surface of the recording material P by heat of the film 33. The recording material P, which has passed through the fixing nip portion N, is separated from the surface of the film 33, and is discharged.

The recording material P is conveyed with the center in its width direction matching a conveyance reference of the image forming apparatus according to the present exemplary embodiment. The conveyance reference of the image forming apparatus is the center of the apparatus in the width direction of the recording material P so that so-called central reference conveyance is performed. Therefore, when a recording material having a smaller width (hereinbelow referred to as "small-size recording material") than a recording material having a maximum width usable in the apparatus is conveyed, non-sheet passing areas are formed outside both edges of the small-size recording material. In the present exemplary embodiment, the longitudinal center of the fixing film 33 also matches a position of the conveyance reference of the apparatus. Therefore, the recording material P is conveyed so that the center in the width direction of the recording material P matches the longitudinal center of the fixing film 33. A conveyance reference line S is a conveyance reference line (virtual line) of the recording material P.

(3) Temperature Detection Member

A position of a thermistor serving as a temperature detection member which detects a temperature of the heater 35 or the film 33 will be described. The thermistor TH1 is provided to detect the temperature of an area, through which all recording materials used in the image forming apparatus pass, of the heater 35. Power supplied to the heater 35 is controlled according to a temperature detected by the thermistor TH1. In the present exemplary embodiment, the thermistor TH1 is provided at the longitudinal center of the heater 35. Thermistors TH2 and TH3 are provided in an end portion in the film 33 so that a temperature of a non-sheet passing area in the recording material P on an inner surface of the film 33 is detected. The thermistors TH2 and Th3 are respectively provided at other ends (free ends) of plate springs 38 each serving as an elastic support member having its one end fixed onto the guide member 34, and contact the inner surface of the film 33 with an elastic force of the plate springs 38. In the present exemplary embodiment, positions where the thermistors TH2 and TH3 are provided are spaced 150 mm and 63 mm, respectively, apart from the longitudinal center of the heater 35. Respective detection information (signal values relating to temperatures) of the thermistors TH1, TH2, and TH3 are input to the control circuit unit 100 via the A/D converter.

While the thermistor TH1 is provided to detect the temperature of the heater 35 in the present exemplary embodiment, the present disclosure is not limited to this example. The thermistor TH1 may be configured to detect a temperature of the inner surface of the film 33, like the thermistors TH2 and TH3. The thermistors TH2 and TH3 may be provided to detect the temperature of the heater 35.

(4) Air Blowing Unit

Figure 7:
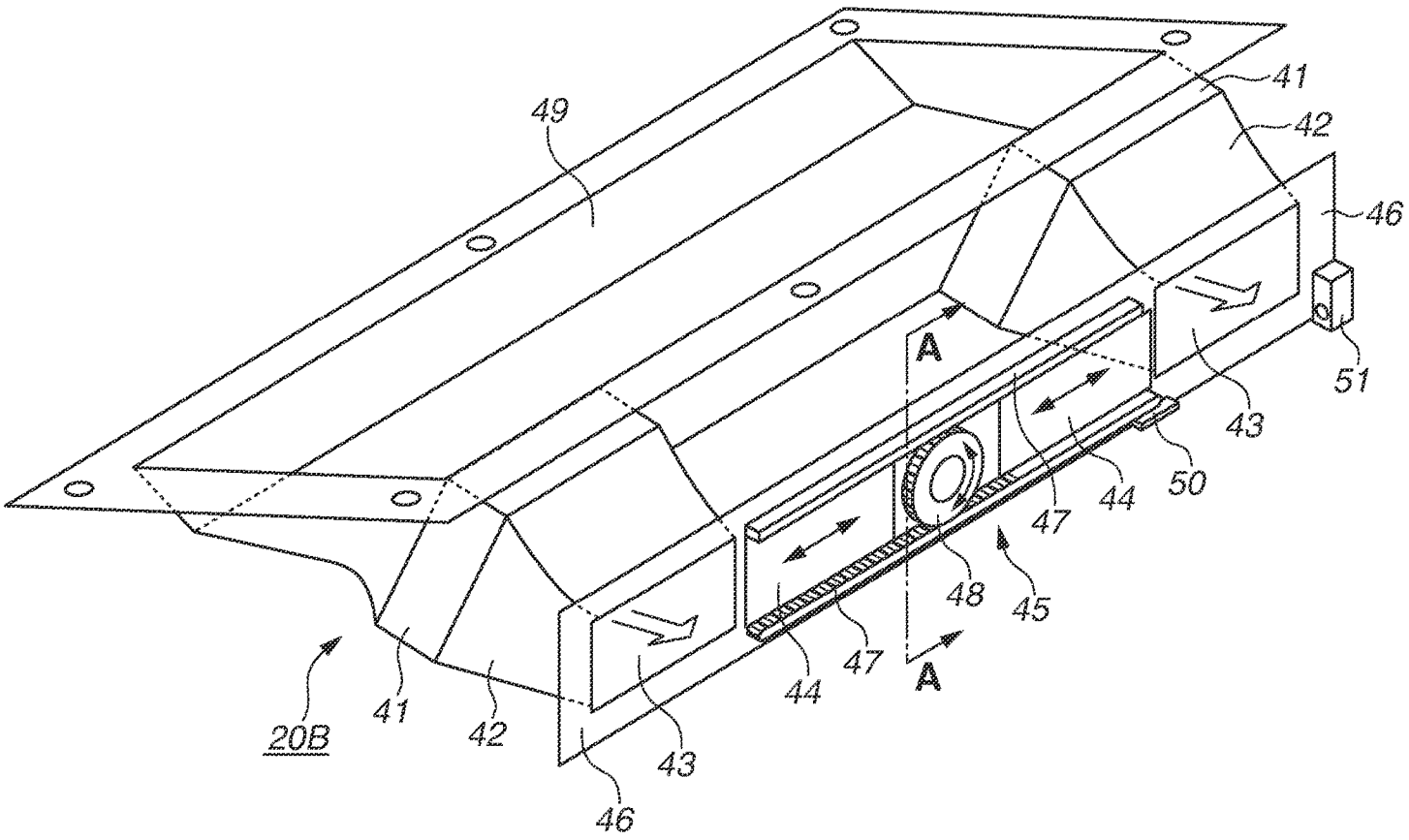
FIG. 7 is a perspective view of an air blowing unit according to an exemplary embodiment.
Figure 8:
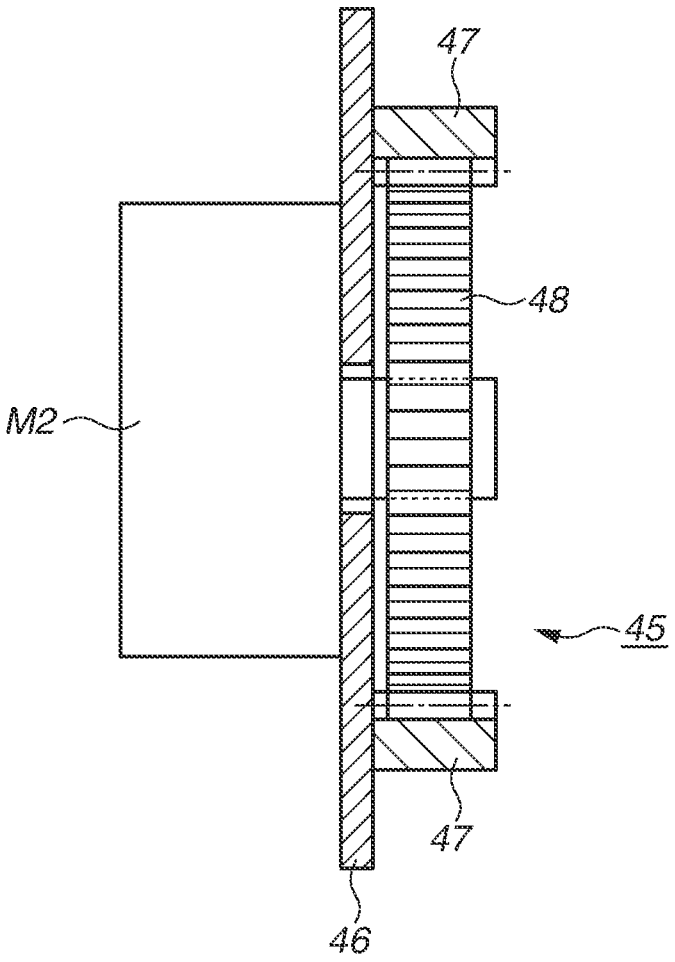
FIG. 8 is a cross-sectional view taken along a line A-A of the air blowing unit illustrated in FIG. 7.

The air blowing unit 20B according to the present exemplary embodiment will be described with reference to FIGS. 1, 7, and 8. FIG. 7 is a perspective view of the air blowing unit 20B. FIG. 8 is a cross-sectional view taken along a line A-A of the air blowing unit 20B illustrated in FIG. 7. The air blowing unit 20B is provided to blow air to suppress a rise in temperature of a non-sheet passing portion in the film 33 occurring when fixing processing is continuously performed on the small-size recording materials. The air blowing unit 20B includes a fan 41 and a duct 42 for guiding air from the fan 41. The duct 42 includes an opening portion 43, and the opening portion 43 is provided at a position opposing an end portion of the film 33 which becomes a non-sheet passing area when fixing processing is performed on the small-size recording material. The air from the fan 41 is guided to the end portion of the film 33 via the opening portion 43. The air blowing unit 20B includes a shutter 44 serving as an adjustment member which adjusts an opening width of the opening portion 43 depending on the width of a recording material to be used and a shutter driving unit 45 which drives the shutter 44.

The fan 41, the duct 42, the opening portion 43, and the shutter 44 are arranged to be bilaterally symmetric in the longitudinal direction of the film 33. A suction channel unit 49 is disposed on the suction side of the fan 41.

While an axial fan is used as the fan 41 in the present exemplary embodiment, a centrifugal fan such as sirocco fan may be used.

A configuration for driving the shutter 44 will be described below. The shutter driving unit 45 includes a support plate 46, rack teeth 47, a pinion gear 48, and a motor M2. Two shutters (left and right shutters) 44 are supported slidably in a horizontal direction along a plate surface of the support plate 46 extending in the horizontal direction in which the opening portion 43 is formed. The shutter 44 is connected with the rack teeth 47 by the pinion gear 48, and the pinion gear 48 is driven to rotate in forward and backward directions by forward and backward driving of the motor (pulse motor) M2. When the pinion gear 48 rotates in the forward and backward directions, the two shutters 44 can synchronously open and close opening portions 43 respectively corresponding thereto. The two opening portions (left and right opening portions) 43 are respectively provided to be opened in ranges of 74 mm (W2/2) to 155 mm (W1/2) from the longitudinal center of the support plate 46. The left and right shutters 44 are configured to be able to respectively close the opening portions 43 by a predetermined amount outwardly from the longitudinal center of the support plate 46.

Figure 9:
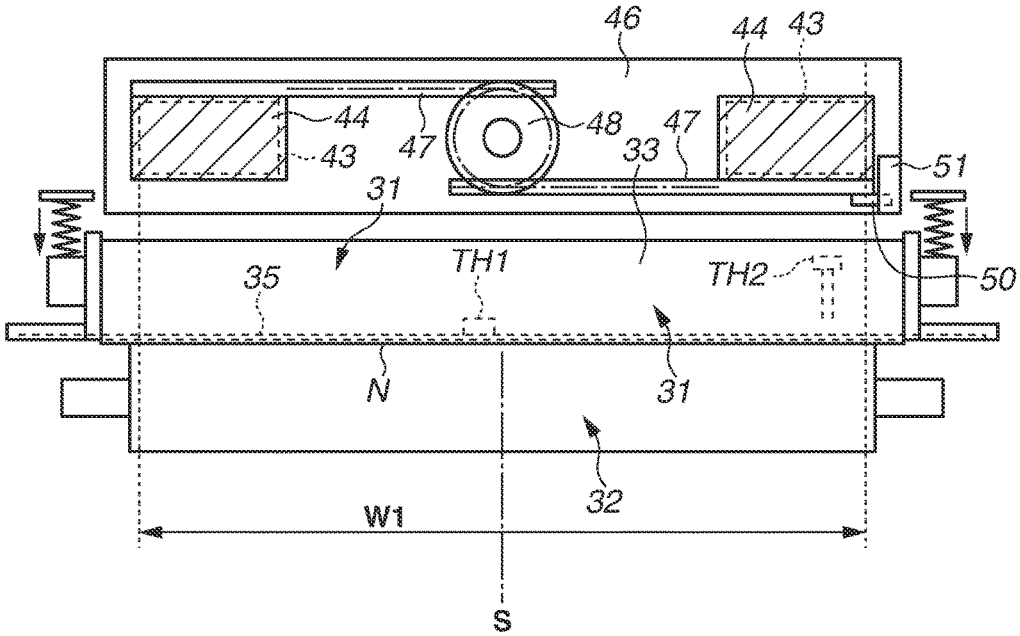
FIG. 9 illustrates a state where a shutter has moved to a fully-closed position where an opening portion is completely closed.
Figure 10:
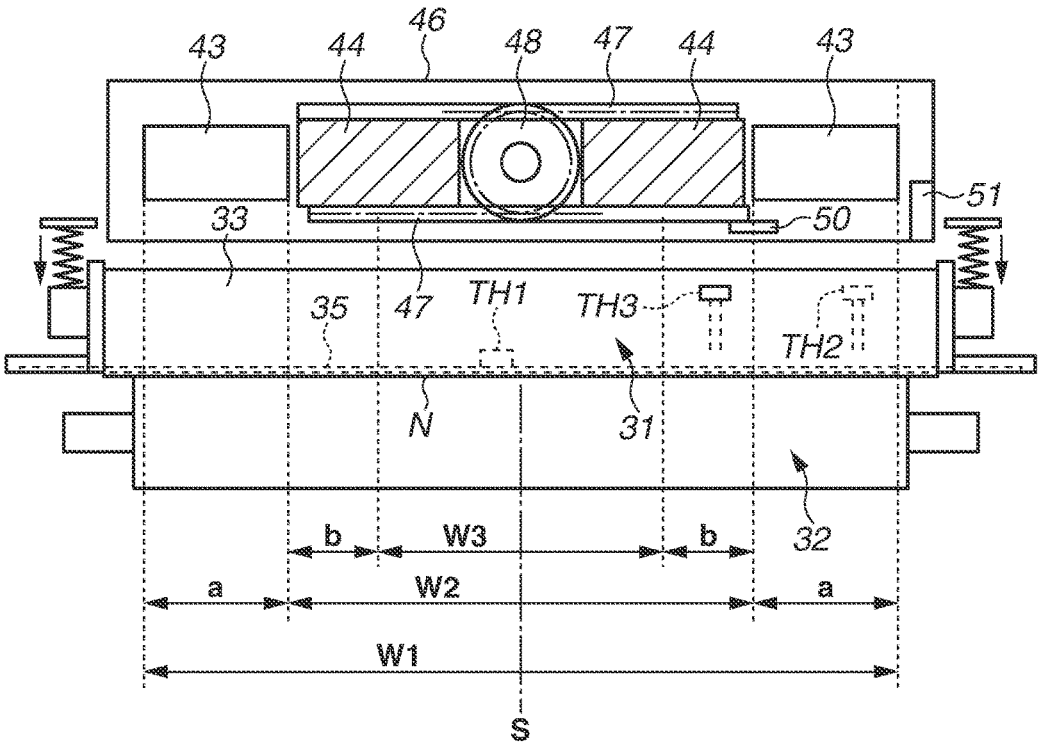
FIG. 10 illustrates a state where the shutter has moved to a fully-opened position where the opening portion is completely opened.

Control of the air blowing unit 20B will be described below with reference to FIG. 6. Information W about the width (size) of a recording material is input to the control circuit unit 100 from a user input or a mechanism for automatically detecting a width of the recording material, which is provided in a sheet feeding cassette 13 or the manual feed tray 17. The control circuit unit 100 drives the motor M2, moves the shutter 44, and adjusts the opening width of the opening portion 43 based on the information W about the width of the recording material. The control circuit unit 100 controls the shutter driving unit 45 when the recording material has a maximum width usable in the image forming apparatus (the A3 size in the present exemplary embodiment), the shutter driving unit 45 is controlled, to move the shutter 44 to a fully-closed position where the opening portion 43 is completely closed by the shutter 44, as illustrated in FIG. 9. When the recording material is a small-size recording material having a width which is less than the width of the A5R size, the shutter 44 is moved to a fully-opened position where the opening portion 43 is fully opened, as illustrated in FIG. 10. When the shutter 44 is at the fully-opened position, the opening width of the opening portion 43 matches the width of the opening portion 43. If the small-size recording material is of the letter R (LTR-R) size, executable (EXE) size, K8 size, or letter (LTR) size, the control circuit unit 100 moves the shutter 44 so that the opening width of the opening portion 43 becomes a width corresponding to the width of a non-sheet passing area for the recording material. For positional information about the shutter 44, a sensor 51 arranged on the support plate 46 detects a flag 50 arranged at a predetermined position of the shutter 44. More specifically, a home position is determined at a position of the shutter 44 at which the opening portion 43 is completely closed, and the opening width of the opening portion 43 is detected from an amount of rotation of the motor M2, as illustrated in FIG. 9.

A sensor, which directly detects the position of the shutter 44, may be provided, to control the movement of the shutter 44 based on detection information from the sensor.

A characteristic configuration and control according to the present exemplary embodiment will be described below. In FIG. 3, a width a is a width of the opening portion 43, and is also a maximum value of an opening width of the opening portion 43. In FIG. 3, an area W1 is an area between respective ends, which are farther from the longitudinal center, of the left and right opening portions 43. A width of the area W1 in the present exemplary embodiment is 310 mm. An area W2 is an area between respective ends, which are closer from the longitudinal center, of the left and right opening portions 43, i.e., a non-air blowing area which is not cooled by direct air blowing by the air blowing unit 30B. A width of the area W2 in the present exemplary embodiment matches the short width 148 mm of the A5 size.

If a recording material (COM10) having a width of a non-air blowing area W3 (105 mm) is used as the small-size recording material, a non-sheet passing area a and a non-sheet passing area b are generated. The non-sheet passing area a is an area opposing the opening portion 43, and thus is directly cooled by air blowing from the air blowing unit 20B (the fan 41). However, the non-sheet passing area b is a part of the non-air blowing area W2, and thus is not directly cooled by air blowing from the air blowing unit 20B. Therefore, if fixing processing is continuously performed on the small-size recording materials having the width of the non-air blowing area W3, the non-sheet passing area b rises in temperature more excessively than the non-sheet passing area a.

Therefore, in the characteristic configuration according to the present exemplary embodiment, the thermistor TH3 is provided in the non-sheet passing area b included in the non-air blowing area W2. Further, in the characteristic control according to the present exemplary embodiment, the fan 41 is controlled based on a temperature detected by the thermistor TH3 when fixing processing is continuously performed on the small-size recording materials having the width of the non-air blowing area W3*d*. In this way, the fan 41 can be controlled while the temperature of the non-sheet passing area b, which reaches the highest temperature, in a non-sheet passing area (a+b) is being monitored. As a result, fixing processing can be performed on the small-size recording material having the width of the non-air blowing area W3 without reducing a throughput (productivity).

An effect of the present exemplary embodiment will be described with reference to FIGS. 10 and 11. In the present exemplary embodiment, the control circuit unit 100 moves the shutter 44 to the fully-opened position, to drive the fan 41 in the air blowing unit 20B based on information indicating that the width of the recording material to be used is the width of the non-air blowing area W3, as illustrated in FIG. 10. The control circuit unit 100 controls the fan 41 depending on the temperature detected by the thermistor TH3.

Figure 11:
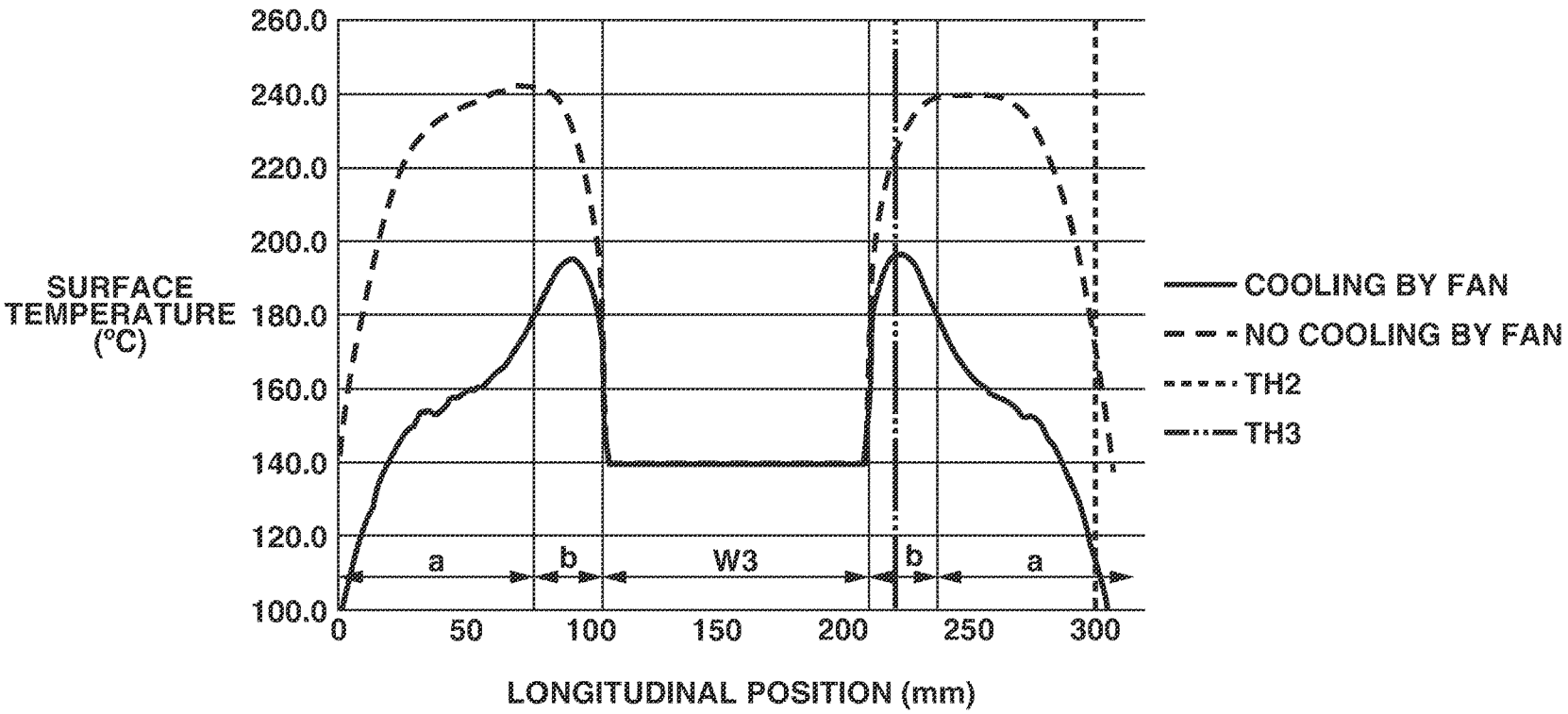
FIG. 11 illustrates distributions in a longitudinal direction of surface temperatures of the film at the time of fixing processing of a small-size recording material.

FIG. 11 illustrates, when fixing processing is continuously performed on the recording materials having the width of the non-air blowing area W3, respective distributions in the longitudinal direction of surface temperatures of the film 33 in cases where cooling is and is not performed by air blowing from the fan 41. If cooling is not performed by air blowing from the fan 41, respective peak temperatures in the non-sheet passing area a and the non-sheet passing area b are high, although not greatly different. Accordingly, to continue the fixing processing, a period to be an interval between the recording material and a succeeding recording material needs to be extended to inhibit the non-sheet passing areas from rising in temperature. On the other hand, if cooling is performed by air blowing from the fan 41, a temperature distribution has a local peak in the non-sheet passing area b, although respective peak temperatures in the non-sheet passing areas a and b are not so high. Therefore, an image forming apparatus not having the thermistor TH3, which detects a temperature of the non-sheet passing area b, cannot detect a local temperature peak in the non-sheet passing area b. Therefore, the fan 41 cannot be easily controlled. In the present exemplary embodiment, the thermistor TH3 can detect the temperature in the non-sheet passing area b. Thus, fixing processing can be performed on even the recording material P having the width of the non-air blowing area W3 while air is being blown thereinto by the air blowing unit 20B. Before the temperature of the non-sheet passing area b reaches a destruction temperature (threshold temperature) T1 of the film 33, the non-sheet passing area b can be inhibited from rising in temperature by extending a period to be an interval between the recording material and a succeeding recording material.

Figure 12:
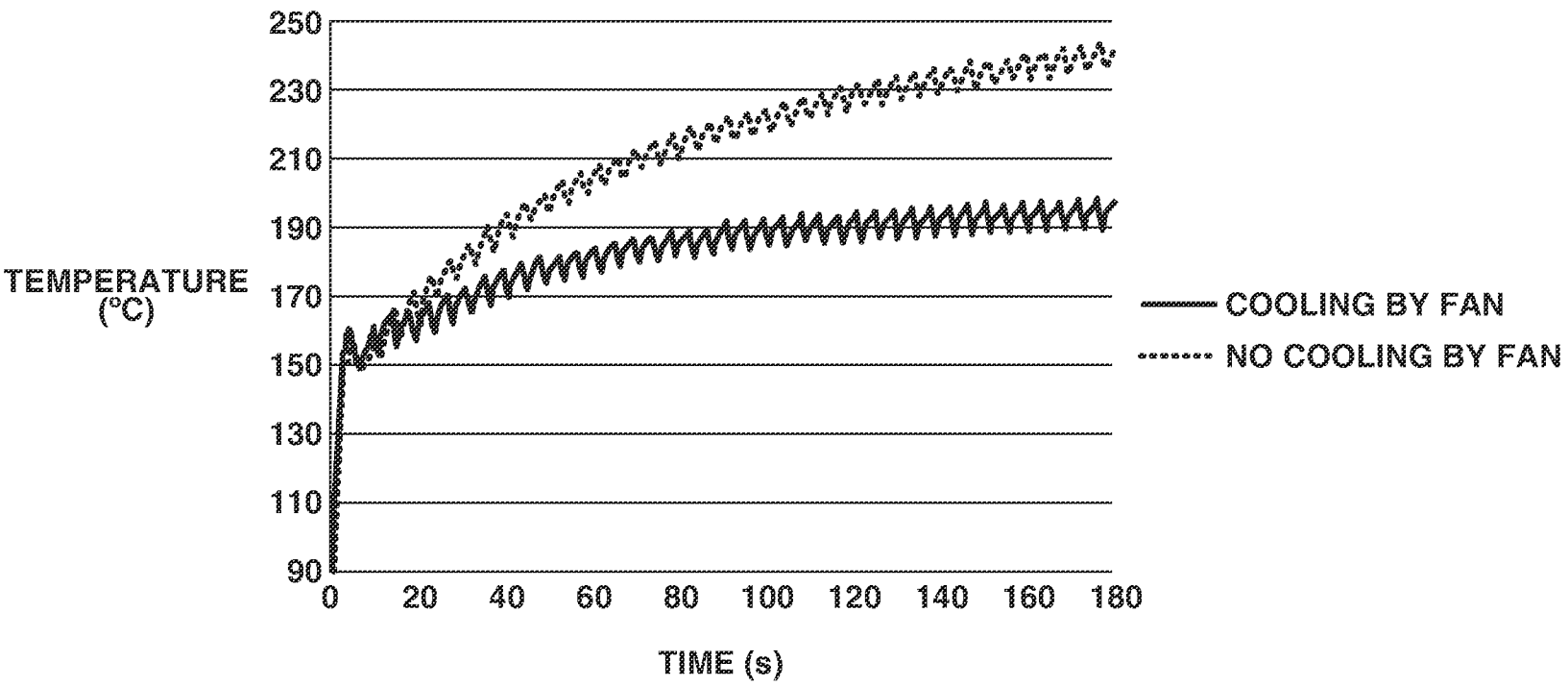
FIG. 12 illustrates time shifts of maximum temperatures on a surface of the film at the time of fixing processing of the small-size recording material.

FIG. 12 illustrates respective time shifts of maximum temperatures on the surface of the film 33 in cases where cooling is and is not performed by air blowing from the fan 41. The temperature on the surface of the film 33 is more suppressed so that the maximum temperature becomes lower when cooling is performed by air blowing from the fan 41 than when cooling is not performed. If fixing processing is performed on the small-size recording material having the width of the non-air blowing area W3, the non-sheet passing area b cannot be directly cooled by air blowing. However, when the non-sheet passing area a is directly cooled by air blowing, transfer of heat from the non-sheet passing area b to the non-sheet passing area a is promoted.

As a comparative example 1, when fixing processing is continuously performed on small-size recording materials (COM10) having the width of the non-air blowing area W3*d*, print productivities of the small-size recording materials in cases where cooling is and is not performed by air blowing from the fan 41 are compared. An image forming apparatus in the comparative example 1 is designed to be protected by reducing a throughput when a maximum temperature on a surface of the film 33 reaches 210° C. In this comparative example 1, a period to be an interval between the recording material and a succeeding recording material is extended, to reduce the throughput. The throughput is 14 pages per minute (PPM) in early stages of printing, and is 9 PPM after the throughput is reduced. The following table represents a result of comparison in the throughput between a case of not cooling by air blowing from the fan 41 and a case of cooling by air blowing from the fan 41.

TABLE 1

| | Number of sheets | When 100 sheets have passed | |
|---|---|---|---|
| | when throughput is maintained at 14 PPM | Average PPM | Required time |
| no cooling by FAN | 16 | 9.5 PPM | 105 min |
| cooling by FAN | 500 | 14 PPM | 7.1 min |

The throughput when 100 sheets have been continuously printed is maintained at an average of 9.5 PPM when a non-air blowing area is not cooled by air blowing from the fan 41 while the throughput is maintained at 14 PPM when the non-air blowing area is cooled so that the throughput is improved by approximately 47%.

If the small-size recording material is a recording material having a width which is the longitudinal length (148 mm) or more of the A5 size and having a smaller width than a maximum width conveyable by the image forming apparatus, an area outside the non-air blowing area W2 becomes a non-sheet passing area. Therefore, the fan 41 is controlled according to a temperature detected by the thermistor TH2 provided outside the non-air blowing area W2 in a width direction of the recording material. More specifically, when fixing processing is continuously performed on recording materials, by which the entire non-air blowing area W2 is overlapped with a sheet passing area and a temperature detection area of the thermistor TH2 is positioned on a non-sheet passing area, the fan 41 is controlled according to the temperature detected by the thermistor TH2.

As described above, according to the present exemplary embodiment, in the fixing device which cools the non-sheet passing area by air blowing from the fan 41, fixing processing can be performed on even the small-size recording material, by which a part of the non-air blowing area is overlapped with the non-sheet passing area, without reducing productivity.

Recording materials respectively having a minimum width and a maximum width usable in the image forming apparatus according to the present exemplary embodiment are of a standard size and are not of a nonstandard size.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-169373, filed Aug. 31, 2016, which is hereby incorporated by reference herein in its entirety.

What is claimed is:

1. An image forming apparatus comprising:

an image forming unit configured to form an unfixed toner image on a recording material;

a fixing unit including a heating unit and a pressure member forming a nip portion with the heating unit, configured to fix the unfixed toner image onto the recording material while the recording material on which the unfixed toner image is formed is being conveyed at the nip portion in a direction crossing with a longitudinal direction of the heating unit;

an air blowing unit including a fan, an opening portion opposing a longitudinal end portion of the heating unit, and a shutter movable so as to open and close the opening portion, configured to blow air from the fan toward the heating unit via the opening portion;

a temperature detection member configured to detect a temperature of the heating unit and a control unit configured to control the fan according to a temperature detected by the temperature detection member while a recording material is being conveyed at the nip portion, wherein, while a recording material having a predetermined size is being conveyed at the nip portion, the heating unit has a non-passing area that does not pass the recording material in the longitudinal direction, and wherein the temperature detection member is disposed on the non-passing area, and the temperature detection member is located in an predetermined area of the heating unit closer to a longitudinal center of the heating unit than an inside edge of the opening portion in the longitudinal direction.

2. The image forming apparatus according to claim 1, further comprising:

a second temperature detection member in a case where the temperature detection member is a first temperature detection member, wherein the second temperature detection member is configured to detect a temperature of an area of the heating unit farther from the longitudinal center of the heating unit than the inside edge of the opening portion in the longitudinal direction.

3. The image forming apparatus according to claim 2, wherein the control unit controls the fan according to a temperature detected by the second temperature detection member while the recording material having the predetermined size is being conveyed at the nip portion.

4. The image forming apparatus according to claim 1, wherein when the temperature detected by the temperature detection member reaches a threshold temperature while a plurality of recording materials each having the predetermined size are continuously being conveyed at the nip portion, an interval between a preceding recording material and a succeeding recording material of the plurality of recording materials is extended.

5. The image forming apparatus according to claim 1, wherein the heating unit includes a cylindrical film and a heater which contacts an inner surface of the film.

6. The image forming apparatus according to claim 1 herein the heater forms the nip portion with the pressure member through the cylindrical film.

7. The image forming apparatus according to claim 1, further comprising:

a duct configured to guide the air from the fan toward the longitudinal end portion of the heating unit, the duct includes the opening portion.

8. The image forming apparatus according to claim 1, wherein the shutter is configured to be moved so as to adjust a blowing region of the opening portion through which the air from the fan passes toward the heating unit according to a size of the recording material which is to be conveyed at the nip portion.

9. An image forming apparatus comprising:

an image forming unit configured to form an unfixed toner image on a recording material;

a fixing unit including a heating unit and a pressure member forming a nip portion with the heating unit, configured to fix the unfixed toner image onto the recording material while the recording material on which the unfixed toner image is formed is being conveyed at the nip portion in a direction crossing with a longitudinal direction of the heating unit;

an air blowing unit including a fan, an opening portion opposing a longitudinal end portion of the heating unit, and a shutter movable so as to open and close the opening portion, configured to blow air from the fan toward the heating unit via the opening portion; and a temperature detection member configured to detect a temperature of the heating unit, wherein, while a plurality of recording material having a predetermined size is being conveyed at the nip portion, the heating unit has a non-passing area that does not pass the recording material in the longitudinal direction, and an interval between a preceding recording material and a succeeding recording material of the plurality of recording materials is extended when the temperature detected by the temperature detection member reaches a threshold temperature, and wherein the temperature detection member is disposed on the non-passing area, and the temperature detection member is located in an predetermined area of the heating unit closer to a longitudinal center of the heating unit than an inside edge of the opening portion in the longitudinal direction.

10. The image forming apparatus according to claim 9, further comprising:

a second temperature detection member in a case where the temperature detection member is a first temperature detection member, wherein the second temperature detection member is configured to detect a temperature of an area of the heating unit farther from the longitudinal center of the heating unit than the inside edge of the opening portion in the longitudinal direction.

11. The image forming apparatus according to claim 10, wherein the control unit controls the fan according to a temperature detected by the second temperature detection member while the recording material having the predetermined size is being conveyed at the nip portion.

12. The image forming apparatus according to claim 9, wherein the heating unit includes a cylindrical film and a heater which contacts an inner surface of the film.

13. The image forming apparatus according to claim 12, wherein the heater forms the nip portion with the pressure member through the cylindrical film.

14. The image forming apparatus according to claim 9, further comprising:

a duct configured to guide the air from the fan toward the longitudinal end portion of the heating unit, the duct includes the opening portion.

15. The image forming apparatus according to claim 9, wherein the shutter is configured to be moved so as to adjust a blowing region of the opening portion through which the air from the fan passes toward the heating unit according to a size of the recording material which is to be conveyed at the nip portion.

* * * * *